US009822487B2

(12) United States Patent
Ahoniemi et al.

(10) Patent No.: US 9,822,487 B2
(45) Date of Patent: Nov. 21, 2017

(54) METHOD FOR PRODUCING A FLUSHABLE HYDROENTANGLED MOIST WIPE OR HYGIENE TISSUE

(71) Applicant: SCA Hygiene Products AB, Göteborg (SE)

(72) Inventors: Hannu Ahoniemi, Göteborg (SE); Lars Fingal, Göteborg (SE); Anders Strålin, Torslanda (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 15/302,214

(22) PCT Filed: Apr. 8, 2014

(86) PCT No.: PCT/SE2014/050432

§ 371 (c)(1),
(2) Date: Oct. 6, 2016

(87) PCT Pub. No.: WO2015/156712

PCT Pub. Date: Oct. 15, 2015

(65) Prior Publication Data

US 2017/0022667 A1 Jan. 26, 2017

(51) Int. Cl.
*D21H 25/00* (2006.01)
*D04H 1/492* (2012.01)
(Continued)

(52) U.S. Cl.
CPC ..... *D21H 13/08* (2013.01); *D04H 1/492* (2013.01); *D04H 1/495* (2013.01); *D04H 1/732* (2013.01); *D04H 18/04* (2013.01); *D21H 27/00* (2013.01)

(58) Field of Classification Search
CPC ..... D21H 13/08; D21H 27/00; D21H 25/00; D21H 25/005; D21H 25/04; D04H 1/492; D04H 18/04; D04H 1/495; D04H 1/732; D04H 1/498; D04H 3/11; D04H 3/03; Y10T 442/689; A47L 3/161; B08B 1/006
See application file for complete search history.

(56) References Cited

U.S. PATENT DOCUMENTS 3,494,821 A * 2/1970 Evans ..... D04H 1/495 162/115
6,592,713 B2 * 7/2003 Ahoniemi ..... D04H 3/02 162/103
(Continued)

FOREIGN PATENT DOCUMENTS

DE 102005036759 A1 8/2006
EP 0215684 A2 3/1987
(Continued)

*Primary Examiner* — Jose Fortuna
(74) *Attorney, Agent, or Firm* — Drinker Biddle & Reath LLP

(57) ABSTRACT

A method for producing a flushable hydroentangled moist wipe or hygiene tissue includes the steps of: dry-, wet-, or foam-forming a fibrous web on a moving support, hydroentangling said fibrous web in a hydroentangling station to form a hydroentangled nonwoven web. The moving support includes a plurality of protruding elongated elements protruding above the surface of the moving support. The protruding elements will produce weakenings in the hydroentangled web.

13 Claims, 3 Drawing Sheets

(51) Int. Cl.

| | |
|---|---|
| ***D04H 18/04*** | (2012.01) |
| ***D21H 13/08*** | (2006.01) |
| ***D21H 27/00*** | (2006.01) |
| ***D04H 1/495*** | (2012.01) |
| ***D04H 1/732*** | (2012.01) |

(56) References Cited

U.S. PATENT DOCUMENTS

| | | | | |
|---|---|---|---|---|
| 7,478,463 | B2 * | 1/2009 | Conner | D04H 1/498 28/104 |
| 2002/0088099 | A1 * | 7/2002 | Ahoniemi | D04H 3/02 28/103 |
| 2003/0088956 | A1 * | 5/2003 | Strandqvist | D04H 18/04 28/104 |
| 2005/0112980 | A1 * | 5/2005 | Strandqvist | D04H 5/03 442/416 |
| 2005/0125908 | A1 * | 6/2005 | Pourdeyhimi | D04H 1/492 8/115.51 |
| 2005/0255297 | A1 * | 11/2005 | Otsuka | D04H 1/498 428/174 |
| 2007/0033779 | A1 * | 2/2007 | Orlandi | D04H 1/425 28/100 |
| 2008/0256768 | A1 * | 10/2008 | Lampila | D04H 1/4258 28/102 |
| 2010/0075120 | A1 * | 3/2010 | Gustafsson | B32B 5/26 428/196 |
| 2010/0269283 | A1 * | 10/2010 | Shim | A47L 13/16 15/209.1 |
| 2011/0119850 | A1 * | 5/2011 | Mallory | A47L 13/16 15/209.1 |
| 2012/0199301 | A1 | 8/2012 | Strandqvist | |
| 2015/0250373 | A1 * | 9/2015 | Strandqvist | D04H 1/492 15/209.1 |
| 2015/0327745 | A1 * | 11/2015 | Machii | A47L 13/16 15/209.1 |
| 2017/0022667 | A1 * | 1/2017 | Ahoniemi | D04H 1/492 |
| 2017/0027392 | A1 * | 2/2017 | Str lin | A61F 13/15211 |

FOREIGN PATENT DOCUMENTS

| | | | | |
|---|---|---|---|---|
| EP | 0511025 | A1 | 10/1992 | |
| EP | 1333868 | A2 | 8/2003 | |
| JP | EP 0215684 | A2 * | 3/1987 | D04H 18/04 |
| JP | EP 0215684 | B1 * | 5/1992 | D04H 18/04 |
| JP | 2002285466 | A * | 10/2002 | D04H 1/498 |
| KR | WO 2006011724 | A1 * | 2/2006 | A44B 18/0011 |
| SE | WO 9922059 | A1 * | 5/1999 | D04H 1/4374 |
| SE | EP 1215325 | A1 * | 6/2002 | D04H 1/498 |
| SE | WO 2006001739 | A1 * | 1/2006 | D04H 1/4382 |
| SE | WO 2008066417 | A1 * | 6/2008 | B32B 5/26 |
| SE | WO 2015156712 | A1 * | 10/2015 | D04H 1/492 |
| WO | WO-02/36084 | A2 | 5/2002 | |
| WO | WO-02/44454 | A2 | 6/2002 | |
| WO | WO-02/066089 | A2 | 8/2002 | |
| WO | WO-02/085272 | A1 | 10/2002 | |
| WO | WO-2008/014842 | A1 | 2/2008 | |

* cited by examiner

METHOD FOR PRODUCING A FLUSHABLE HYDROENTANGLED MOIST WIPE OR HYGIENE TISSUE

CROSS-REFERENCE TO PRIOR APPLICATION

This application is a §371 National Stage Application of PCT International Application No. PCT/SE2014/050432 filed Apr. 8, 2014, which is incorporated herein in its entirety.

TECHNICAL FIELD

The present disclosure refers to a method for producing a flushable hydroentangled wipe or hygiene tissue impregnated with a wetting composition.

BACKGROUND

Pre-moistened wipes or hygiene tissue, are commonly used for cleansing different parts of the human body. Examples of specific uses are baby care, hand wiping, feminine care and toilet paper or a complement to toilet paper.

Since a long period of time often elapses from the time of manufacture of pre-moistened wipes until the time of use, they must have a sufficient structural integrity for their intended wiping function during such period. Adding a wet strength agent to the wipe will provide such wet integrity. However, especially when used as toilet paper, there is a strong desire that the wipe or tissue can be flushed in the sewer without causing problems with blocked pipes and filters. Wipes or tissue having a high wet strength will not disintegrate or break up into small fibre clumps when flushed in conventional household toilet systems, which may cause plugging of the drainage system.

Previously moist flushable pre-moistened toilet papers which were on the market were flushable due to their small size. They could move along the drainage and sewage pipes, but were not readily dispersible and could therefore cause problems with blocked pipes and filters. Nowadays disintegratable materials are available for use in flushable wipes and hygiene tissue.

WO 02/44454 discloses a laminate nonwoven web that is flushable. The nonwoven web is produced by providing first and second nonwoven layers on a moving support and laminating the two layers by pattern hydroentanglement. Hydroentanglement manifolds with jet clusters are used having a plurality of jet orifices separated from each other. The jet clusters thus organized in separate and distinct clusters creates alternating strongly bonded areas and weakly bonded areas along MD (machine direction). These weakly bonded areas allow the laminate to delaminate, thus making it flushable.

US 2012/0199301 discloses a flushable moist wipe or hygiene tissue comprising a hydroentangled nonwoven material. The moist wipe has a relatively low strength in CD (cross direction) and a length in MD which exceeds the width in CD with at least 25%. The low strength CD strength makes it possible for the wipe to disintegrate when flushed in a sewer.

EP 1 333 868 discloses flushable pre-moistened absorbent products comprising mechanically weakened web, wherein the mechanically weakened region comprises at least 20% of the total area of the product. The mechanical weakening can be accomplished by cutting, slitting, perforating, tensioning, ring rolling and the like.

There is however still a need for a moist wipe or hygiene tissue which has sufficient structural integrity for its intended wiping function but which is readily disintegratable when flushed in a sewer.

SUMMARY

It is desired to provide a method for producing a moist wipe or hygiene tissue solving the above problem. Disclosed here is a method including the steps of: dry-, wet-, or foam-forming a fibrous web on a moving support, hydroentangling said fibrous web in a hydroentangling station to form a hydroentangled nonwoven web, wherein said moving support includes a plurality of protruding elongated elements protruding above the surface of the moving support, wherein said protruding elements will produce weakenings in the hydroentangled web.

These weakenings are in the form of areas having a lower basis weight than the surrounding areas or are even through holes in the web. The weakenings will result in a material that more easily disintegrates and disperses in water under mild agitation, such as occurring in a standard sewer.

The protruding elongated elements may have a height h protruding above the plane of the moving support of at least 0.5 times the thickness of the hydroentangled nonwoven web in dry condition and not more than 1.0 time the thickness of the hydroentangled nonwoven web in dry condition.

The protruding elongated elements may have a width W between 0.5 and 2 mm.

The protruding elongated elements may have a length L between 3 and 30 mm, between 10 and 25 mm, or between 20 and 25 mm.

The protruding elongated elements may have a length/width relationship L/W between 1.5 and 60, between 5 and 50, or between 10 and 50.

The protruding elongated elements may have their length direction oriented at an angle of ±45° with respect to the machine direction MD of the moving support.

The protruding elongated elements may have their length direction oriented in the machine direction MD.

The protruding elongated elements may be arranged in a plurality of rows, wherein said rows extend at an angle of ±45° with respect to the machine direction MD of the moving support. Said rows may extend in the machine direction (MD).

The distance a1 between adjacent protruding elongated elements in said rows may be between 10 and 45 mm, between 15 and 40 mm, or between 20 and 35 mm.

The rows may be arranged at a distance a2 from each of between 5 and 40 mm, or between 10 and 30 mm.

The protruding elongated elements in a row may be oriented with their length L direction aligned.

The protruding elongated elements may have a straight configuration.

The moving support 10 may be a hydroentangling fabric.

DETAILED DESCRIPTION OF PARTICULAR EMBODIMENTS

A premoistened wipe or hygiene tissue includes a hydroentangled nonwoven material impregnated with a wetting composition. The wetting composition may contain a major proportion of water and other ingredients depending on the intended use. Wetting compositions useful in moist wipes and hygiene tissue are well-known in the art.

Hydroentangling or spunlacing is a technique for forming a nonwoven web introduced during the 1970'ies, see e g CA patent no. 841 938. The method involves forming a fibre web, which is either drylaid or wetlaid, after which the fibres are entangled by means of very fine water jets under high pressure. Several rows of water jets are directed against the fibre web, which is supported by a movable support, such as a foraminous fabric or a perforated drum. In this process, the fibres entangle with one another providing sufficient bonding strength to the fibrous web without the use of chemical bonding agents. The entangled fibrous web is then dried. The fibres that are used in the material can be natural fibres, especially cellulosic pulp fibres, manmade staple fibres, and mixtures of pulp fibres and staple fibres. Hydroentangled materials can be produced with high quality at a reasonable cost and they possess a high absorption capacity.

Figure 1:
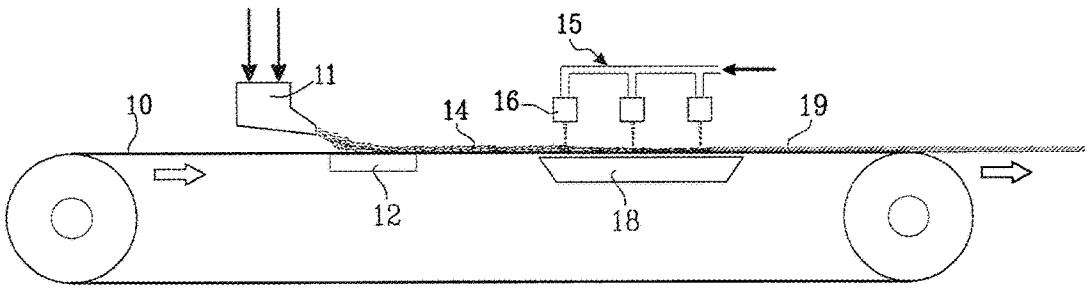
FIG. 1 illustrates schematically a method for producing a hydroentangled nonwoven material.

One example of a method for producing the hydroentangled nonwoven material is shown in FIG. 1. A slurry including fibres of optional kind is wetlaid on a moving forming fabric 10 by a headbox 11. The slurry may besides water contain conventional papermaking additives such as wet and/or dry strength agents, retention aids and dispersing agents. A special variant of wetlaying or wet-forming is foam-forming, wherein the fibres are dispersed in a foamed liquid containing water and a surfactant. The liquid or foam is sucked through the forming fabric 10 by means of suction boxes 12 arranged under the forming fabric, so that a fibrous web 14 is formed on the forming fabric 10. Foam-forming is described in for example WO 96/02702 A1. An advantage of foam-forming is that it requires less liquid to be pumped and sucked through the forming fabric as compared to traditional wet-forming without foam. The fibrous web may also be an air-formed web.

The fibrous web 14 is hydroentangled in a hydroentangling station 15 while it is supported on the forming fabric 10. Alternatively, the fibrous web is transferred to a second support member, for example a second forming fabric or a perforated drum, before hydroentanglement. The hydroentangling station 15 includes at least one jet strip 16. In the embodiment of FIG. 1, three jet strips 16 are provided. Very fine water jets under pressure are directed against the fibrous web 14 from these jet strips 16 to provide an entangling of the fibres and thus form a hydroentangled nonwoven web 19. Suction boxes 18 are arranged under the forming fabric 10 just opposite the hydroentangling station 15. The dewatered hydroentangled nonwoven web 19 is then brought to a drying station (not shown) before the finished material is reeled up and converted to the desired product. The hydroentangled nonwoven material is converted into wipes or hygiene tissue having appropriate dimensions and wetted with a wetting composition as referred to above.

In the hydroentangling process, the fibres entangle with one another providing bonding strength to the fibrous web without the use of chemical bonding agents. The wipe or hygiene tissue may contain no or a small amount of wet strength agent. As used herein, a "small amount" means up to 0.1 wt % of a wet strength added calculated on the dry weight of the wipe or hygiene tissue. High amounts of a wet strength agent will deteriorate the flushability of the wipe or hygiene tissue and make it more difficult to break up and disperse in a sewer.

The wipe or hygiene tissue may contain optional fibers and fiber mixtures. An example of suitable fibers is a mixture of cellulosic pulp fibers and manmade fibers, for example biodegradable manmade fibers such as regenerated cellulose fibres, e.g. viscose, rayon and lyocell, and/or poly(lactic acid) fibers. The length of these manmade fibres may be in the range of 4 to 20 mm. Other natural fibres than pulp fibres may also be included in the fibrous web, such as cotton fibres, sisal, hemp, ramie, flax etc. These natural fibres usually have a length of more than 4 mm.

Cellulose pulp fibres can be selected from any type of pulp and blends thereof. For example, the pulp can be entirely natural cellulosic fibres and can include wood fibres as well as cotton. For example, pulp fibres are softwood papermaking pulp, although hardwood pulp and non-wood pulp, such as hemp and sisal may be used. The length of pulp fibres may vary from less than 1 mm for hardwood pulp and recycled pulp, to up to 6 mm for certain types of softwood pulp. Pulp fibres are advantageous to use since they are inexpensive, readily available and absorbent.

A suitable proportion of cellulose pulp fibers and manmade fibers in the nonwoven material forming the moist wipe or hygiene tissue may be between 70% and 95% by weight cellulose pulp fibers and between 5% and 30% by weight manmade fibers. The wipe or hygiene tissue may have a basis weight in the range 30 to 100 gsm, or 40 to 80 gsm, based on the dry weight of the material.

The moving support used for supporting the fibrous web in the hydroentangling station 15 includes a plurality of protruding elongated elements 17 which protrude above the surface of the moving support, i.e. the forming fabric 10 or a second foraminous fabric (hydroentangling fabric) to which the fibrous web has been transferred before it enters the hydroentangling station 15. The moving support may also be in the form of a perforated drum, membrane, moulded plastic structure, metal plate or the like. The surface of the moving support is herein defined as the plane of the moving support excluding the protruding elongated elements 17. The protruding elements 17 may protrude at least a distance corresponding to 0.5 times the thickness of the hydroentangled nonwoven material in dry condition and not more than 1.0 time the thickness of the hydroentangled nonwoven material in dry condition. A normal thickness of a hydroentangled nonwoven web is between 0.2 mm and 1.5 mm and therefore the distance that the protruding elements protrude above the surface of the moving support will typically be in the range 0.1 mm and 1.5 mm.

The thickness of the hydroentangled nonwoven material is measured according to bulking thickness defined by SS-EN ISO 12625-3:2005.

The protruding elements 17 have an elongated shape with a length L and a width W. The length L is defined as the longest straight line that can be drawn/found in the element. The width W is defined as the longest straight line that can be found/drawn in said element perpendicular to the line L. No parts of the lines L and W should cross the edge of the element, i.e. the full length of the lines L and W must be inside the element. In cases where two or more lines with the same length can be found (L1=L2= . . . Lx), the length L which generates the longest line W, i.e. resulting in the lowest L/W ratio, should be used.

Figure 3:
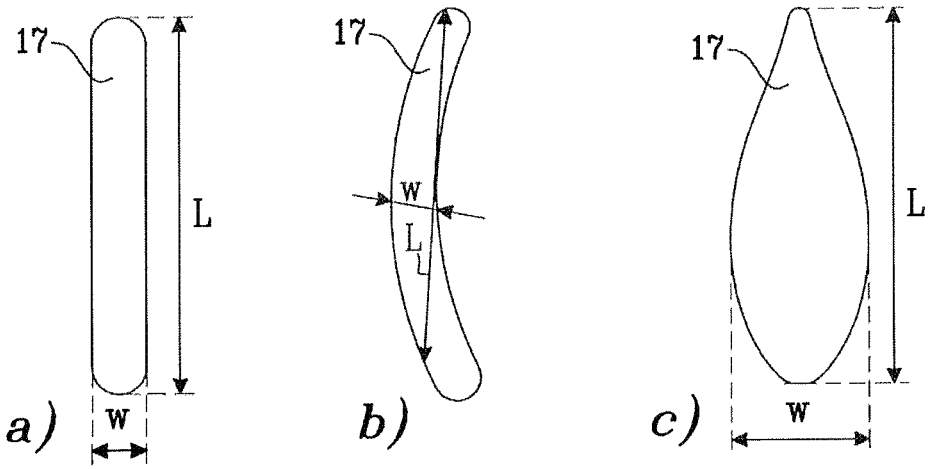
FIGS. 3*a-c* are schematic sketches on an enlarged scale of protruding elements having different shapes and illustrate how the length (L) and width (W) is measured.
Figure 4:
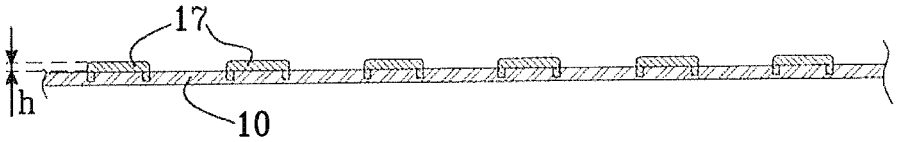
FIG. 4 is a schematic longitudinal section through a moving support including protruding elements.

FIGS. 3 *a-c* illustrate how the length L and the width W are measured for protruding elongated elements 17 of varying shapes. In particular embodiments, they have a width W in the range 0.5 to 2 mm and a length L in the range between 3 and 30 mm, or in the range between 10 and 25 mm, or in the range between 20 and 25 mm. Their length/width relationship L/W can be in the range between 1.5 and 60, in the range between 5 and 50, or in the range between 10 and 50. The protruding elements 17 in one moving support may have the same or different shapes and dimensions. The elements in FIG. 3*a* and FIG. 3*c* are straight, while the element in FIG. 3*b* has a curved shape.

The protruding elongated elements 17 may be of metal or plastic material and may be integrated in the support member at the manufacture thereof or be applied separately to an existing support member.

The protruding elongated elements 17 will create weakenings in the form of areas of lower basis weight or even through holes in the hydroentangled nonwoven web, since the fibers will tend to accumulate on the surface of the moving support in the areas between the protruding elongated elements 17. These weakenings will make the hydroentangled nonwoven and the moist wipe or hygiene tissue made thereof to more easily be torn apart and to disintegrate when flushed in a sewer, where it is exerted to mechanical agitation.

The protruding elongated elements 17 can be arranged in specific configurations and patterns to provide as effective disintegration as possible. It is often desired that the tensile strength in the machine direction, MD, of the nonwoven web is sufficiently strong for the intended wiping function, wherein it is assumed that the wiping direction is the MD. However the strength in the cross direction, CD, which normally is the weakest direction, may have a considerably lower tensile strength to provide the desired disintegration. A suitable tensile strength in the CD may be in the range between 50 and 200 N/m.

In order to weaken the nonwoven web mainly in CD, the protruding elongated elements 17 may be oriented with their length (L) direction at an angle $\alpha$ of ±45° with respect to the machine direction MD. In one embodiment, the protruding elongated elements 17 are oriented with their length (L) direction in the machine direction (MD).

The protruding elongated elements 17 may be arranged in a plurality of rows, which may extend substantially in parallel. The distance a1 between adjacent protruding elongated elements 17 in a row may be in the range between 10 and 45 mm, in the range between 15 and 40 mm, or in the range between 20 and 35 mm. The distance a1 in one row may be the same or vary along the row. The distance a2 between adjacent rows may be in the range between 5 and 40 mm, or in the range between 10 and 30 mm.

Figure 2A:
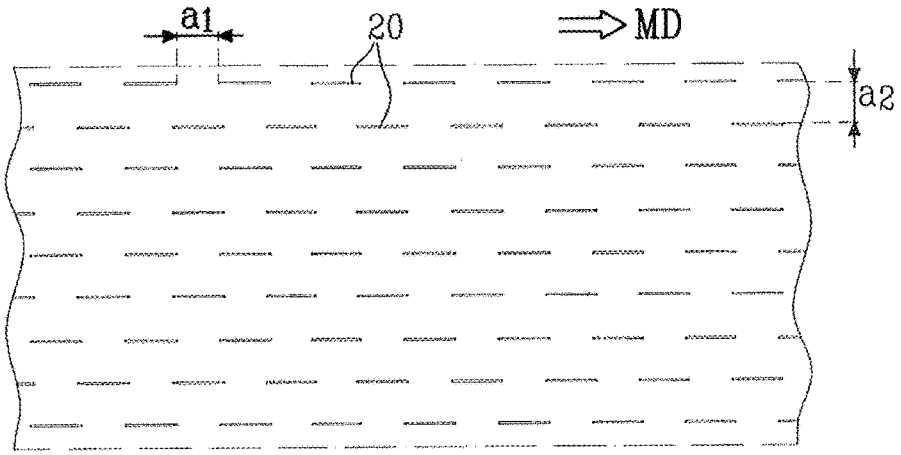
FIG. 2*a* illustrates schematically, in a view from above, a moving support in the form of a hydroentangling fabric having a plurality of protruding elements thereon.
Figure 2B:
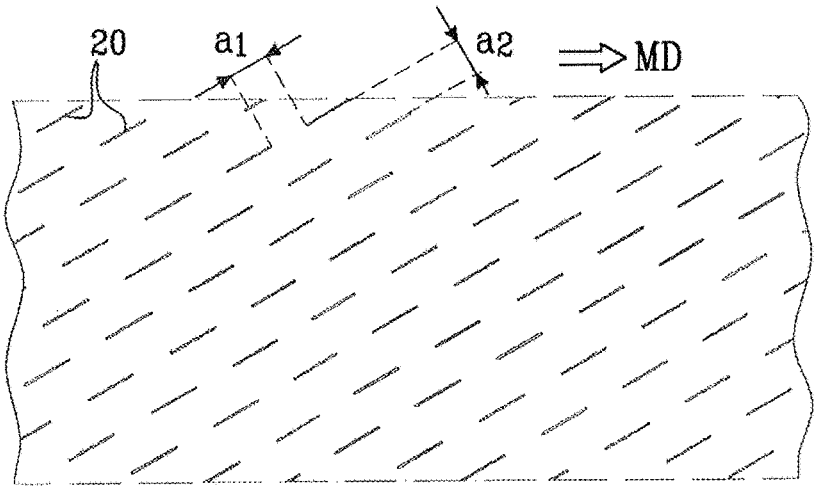
FIG. 2*b* and FIG. 2*c* are similar to FIG. 2*a*, but illustrates alternative configurations of the protruding elements on the hydroentangling fabric.
Figure 2C:
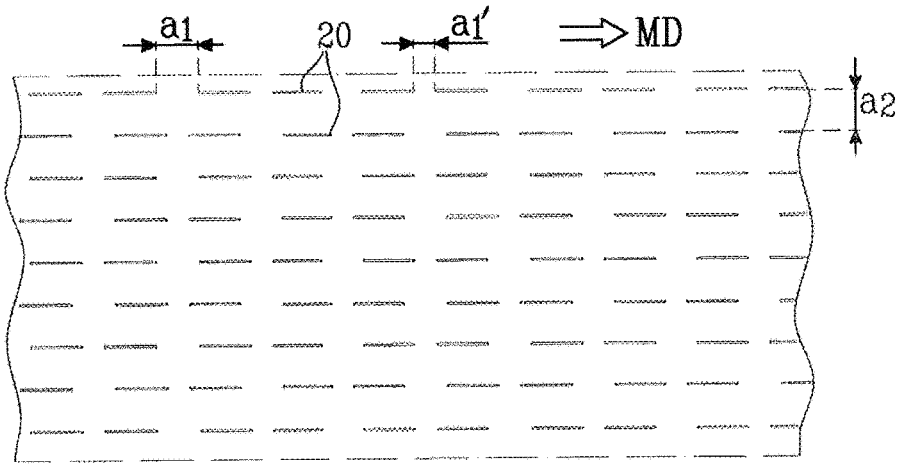

The protruding elongated elements 17 in respective rows may be aligned along their length direction (L) so that tearing indications are formed along the respective row. Such a configuration is shown in the FIGS. 2*a-c*.

The configuration of the protruding elongated elements 17 may also provide a patterning effect to the hydroentangled material, thus the effect may be both a weakening effect and a visual effect.

EXAMPLES

Trials have been made by hydroentangling fibrous webs on a hydroentangling fabric including protruding elements in different configurations. All samples had the following fibre composition:

> 80 wt % cellulose pulp+10 wt % lyocell fibers from Lenzing 1.7 dtex×12 mm+10 wt % PLA:poly (lactic acid) fibers from Trevira 1.7 dtex×12 mm.

The entanglement was made with 3 manifolds (jet strips) on both sides of the web with 60 bars with standard entanglement nozzles having a hole diameter of 115 μm with a pitch of 0.8 mm (Table 1) or 0.6 mm (Table 2) between holes. The first entanglement with 3 manifolds was made on a standard entanglement fabric without protruding elongated elements and the second entanglement with 3 manifolds from the opposite side of the fibrous web was made on an entangling fabric with protruding elongated elements. The basis weight of the hydroentangled nonwoven was 60 gsm.

The moving support on which the fibrous web was supported during hydroentangling was a hydroentanglement fabric from Albany International Formtech 310K. A plurality of protruding elements 17 are arranged on the hydroentanglement fabric. The protruding elongated elements 20 in the test are in the form of staple elements having a length of 12 mm or 24 mm, a width of 0.5 mm and a height protruding above the surface of the hydroentanglement fabric of 0.5 mm.

Different configurations of the protruding elongated elements 17 on the hydroentanglement fabric were tested. The protruding elongated elements 17 were however in all test arranged aligned in length direction (L) in parallel rows extending in machine direction (MD) or at an angle $\alpha$ of 45° with respect to machine direction (MD).

The following test results were obtained. The materials in Table 2 were hydroentangled with 33% more entanglement energy than the materials in Table 1 (pitch between holes 0.6 mm instead of 0.8 mm).

TABLE 1

| Sample | Number of measurements | Staple length (mm) | Dist. betw. staples (mm) | Dist. betw. rows (mm) | Orientation | Disint. time (sec) | % lower than ref. | Wet tensile strength CD (N/m) |
|---|---|---|---|---|---|---|---|---|
| Ref. 1 | 16 | N/A | N/A | N/A | N/A | 152 | N/A | 13.2 |
| 1 | 3 | 12 | 10 | 20 | MD | 140 | 8 | 14.9 |
| 2 | 7 | 12 | 30 | 20 | MD | 140 | 8 | 12.8 |
| 3 | 4 | 12 | 47 | 20 | MD | 148 | 2 | 12.1 |
| 4 | 3 | 12 | 30 | 10 | MD | 138 | 9 | 12.9 |

TABLE 1-continued

| Sample | Number of measure-ments | Staple length (mm) | Dist. betw. staples (mm) | Dist. betw. rows (mm) | Orientation | Disint. time (sec) | % lower than ref. | Wet tensile strength CD (N/m) |
|---|---|---|---|---|---|---|---|---|
| 6 | 3 | 12 | 30 | 30 | MD | 136 | 10 | 14.2 |
| 7 | 3 | 12 | 30 | 20 | 45° | 141 | 7 | 13.3 |
| 8 | 3 | 24 | 30 | 20 | MD | 125 | 18 | 14.4 |

TABLE 2

| Sample | Number of measure-ments | Staple length (mm) | Dist. betw. staples (mm) | Dist. betw. rows (mm) | Orien-tation | Disint. time (sec) | % lower than ref. |
|---|---|---|---|---|---|---|---|
| Ref. 2 | 4 | N/A | N/A | N/A | N/A | 257 | N/A |
| 9 | 4 | 12 | 27 | 20 | MD | 216 | 16 |
| 10 | 4 | 12 | 47 | 20 | MD | 244 | 5 |

Wet strength in water in CD was measured according to SS-EN ISO 12625-5:2005 Disintegration time was measured according to French Standard NF Q 34-20 Aug. 1998.

The invention claimed is:

1. A method for producing a flushable wipe or hygiene tissue comprising a hydraulically entangled nonwoven material impregnated with a wetting composition, said method comprising:

dry-, wet-, or foam-forming a fibrous web on a moving support; and hydroentangled said fibrous web in a hydroentangling station to form a hydroentangled nonwoven web, wherein said moving support is a hydroentangling fabric, which comprises a plurality of protruding elongated elements protruding above the plane of the moving support, and wherein said protruding elements produces weakenings in the hydroentangled web during hydroentangling.

2. The method according to claim 1, wherein said protruding elongated elements have a height protruding above the plane of the moving support of at least 0.5 times the thickness of the hydroentangled nonwoven web in dry condition and not more than 1.0 time the thickness of the hydroentangled nonwoven web in dry condition.

3. The method according to claim 1, wherein said protruding elongated elements have a width between 0.5 and 2 mm.

4. The method according to claim 1, wherein said protruding elongated elements have a length between 3 and 30 mm.

5. The method according to claim 1, wherein said protruding elongated elements have a length/width relationship between 1.5 and 60.

6. The method according to claim 1, wherein said protruding elongated elements have their length direction oriented at an angle of ±45° with respect to the machine direction of the moving support.

7. The method according to claim 6, wherein said protruding elongated elements have a length direction oriented in the machine direction.

8. The method according to claim 1, wherein said protruding elongated elements are arranged in a plurality of rows, wherein said rows extend at an angle of 45° with respect to the machine direction of the moving support.

9. The method according to claim 8, wherein said rows extend in the machine direction.

10. The method according to claim 8 , wherein a distance between adjacent protruding elongated elements in said rows is between 10 and 45 mm.

11. The method according to claim 8, wherein a distance between adjacent rows between 5 and 40 mm.

12. The method according to claim 8, wherein the protruding elongated elements in a row are oriented with their length direction aligned.

13. The method according to claim 1, wherein said protruding elongated elements have a straight configuration.

* * * * *